US006332460B1

(12) United States Patent
Paesani

(10) Patent No.: US 6,332,460 B1
(45) Date of Patent: Dec. 25, 2001

(54) GAS BURNER PARTICULARLY FOR INCORPORATED COOKING HOBS OF A GAS COOKER

(75) Inventor: Carlo Paesani, Camerano (IT)

(73) Assignee: Officine Meccaniche Defendi S.R.L., Camerano (IT)

( * ) Notice: Subject to any disclaimer, the term of this patent is extended or adjusted under 35 U.S.C. 154(b) by 0 days.

(21) Appl. No.: 09/492,410

(22) Filed: Jan. 27, 2000

(30) Foreign Application Priority Data

Jan. 29, 1999 (IT) ..... VE99A0006

(51) Int. Cl.[7] ..... F23D 14/02

(52) U.S. Cl. ..... 126/39 R; 431/284

(58) Field of Search ..... 126/39 R, 39 H; 431/266, 354, 284; 239/558, 559

(56) References Cited

U.S. PATENT DOCUMENTS

| | | | | |
|---|---|---|---|---|
| 2,781,779 | * | 2/1957 | Kindl | 126/39 H |
| 5,277,576 | * | 1/1994 | Hartung et al. | 126/39 R |
| 5,401,164 | * | 3/1995 | Yen | 126/39 R |
| 5,704,778 | * | 1/1998 | Hsieh | 126/39 R |
| 5,842,849 | * | 12/1998 | Huang | 162/39 R |
| 6,132,205 | * | 10/2000 | Harneit | 126/39 R |

* cited by examiner

*Primary Examiner*—Sara Clarke
(74) *Attorney, Agent, or Firm*—Birch, Stewart, Kolasch & Birch, LLP

(57) ABSTRACT

A gas burner assembly particularly for incorporated cooking hobs in a gas cooker, having at least two nozzles selectively feedable to form corresponding gas/air mixtures in two separate mixing chambers provided with flame orifices, said flame orifices being positioned on two different levels. The burner assembly is selectively operable to provide a full range of gas cooking powers.

10 Claims, 1 Drawing Sheet

GAS BURNER PARTICULARLY FOR INCORPORATED COOKING HOBS OF A GAS COOKER

FIELD OF THE INVENTION

This invention relates to a gas burner assembly, particularly for incorporated cooking hobs of a gas cooker. More specifically, the present invention relates to a high-power burner assembly.

DESCRIPTION OF THE INVENTION

Gas burners are known for food cooking, comprising a burner body fed via nozzle by a gas stream which entrains a primary air stream and mixes with this latter to form a mixture which when suitably ignited generates a ring of radial flames the size of which can be adjusted by a cook positioned upstream of the nozzle.

Cooking appliances generally comprise burners with different outer flame diameters correlated with the power to be delivered, a currently increasing tendency being to include within the appliance at least one burner of high power.

The inclusion of high-power burners involves however certain limitations of a constructional and regulatory type.

A principal constructional limitation is due to the fact that in domestic appliances there is a need to be able to convert the use of the burner from one type of gas to another without having to completely open the cooker to replace the injector. In practice this means that it must be possible to replace one injector with another without having to remove important parts of the cooker. This means that the burner venturi duct has to be made small, so limiting the power obtainable from that burner.

Regulatory limitations impose a limit on the temperature of those parts of the cabinet in contact with the appliance, this certainly being an obstacle to the installation of high-power burners. For example in the U.S.A. the regulations do not allow the burner flames to emerge beyond the perimeter of the cooking pan, this being a severe test for very powerful burners.

To increase the power the diameter of the burner head must be increased to be able to disperse the larger air-gas mixture quantity through a larger number of flame orifices in order to restrict the flame length.

However even with a suitable burner head diameter the flames are often lengthy, especially when the gas pressure is low as is the case in the U.S.A., and they therefore tend to extend beyond the pan perimeter.

This situation also results in a burner efficiency problem, in that as the flames exert their main action on the outer edge of the pan rather than on its centre, the burner efficiency is low.

An object of the invention is to provide a burner which is of high power but at the same time has small head dimensions, producing sufficiently short flames.

A further object of the invention is to provide a burner which is of high power while at the same time being able to provide a very low minimum power, and hence the widest possible cooking range.

BRIEF SUMMARY OF THE INVENTION

These and further objects which will be more apparent from the ensuing description are attained according to the invention by a gas burner particularly for incorporated cooking hobs, comprising a burner body comprising at least two nozzles selectively feedable to form corresponding gas/air mixture in two separated mixing chambers provided with flame orifices, said flame orifices being positioned on two different levels.

BRIEF DESCRIPTION OF THE DRAWINGS

A preferred embodiment of the invention is described in detail hereinafter with reference to the accompanying drawings, on which.

DESCRIPTION OF A PREFERRED EMBODIMENT

Figure 1:
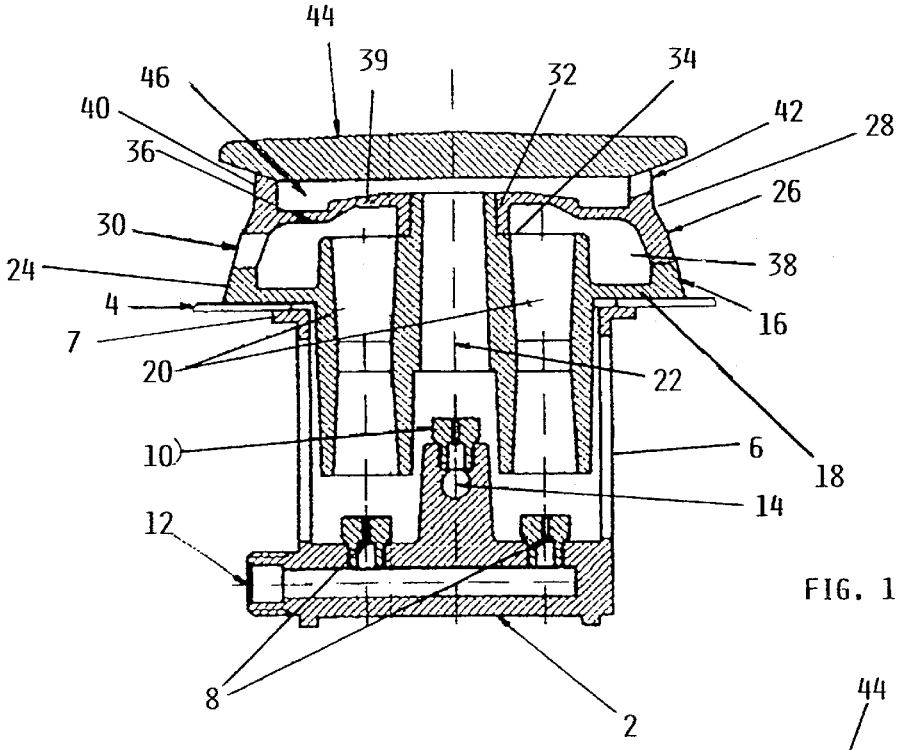
FIG. 1 is a longitudinal section through a burner of the invention.
Figure 2:
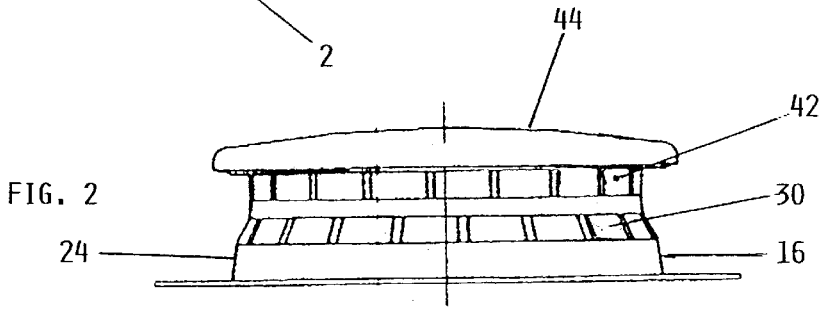
FIG. 2 is a side view of that part thereof projecting from the cooking hob.
Figure 3:
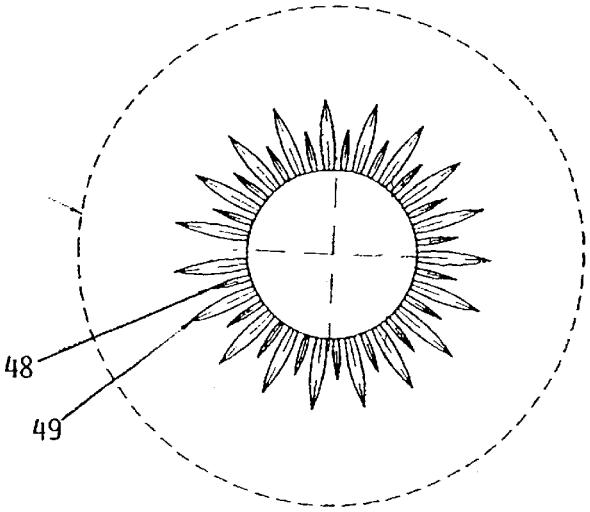
FIG. 3 is a plan view thereof

As can be seen from the figures, the burner of the invention comprises substantially an injector carrier 2 fixed at its upper annular edge 7 to the top 4 of a cooker and provided with a plurality of apertures 6.

On the injector carriers 2 there are mounted two nozzles 8 positioned diametrically about a central third nozzle 10 which is positioned at a greater height from the base of the injector carrier than the nozzles 8.

The two nozzles 8 communicate with a gas feed conduit 12, while the nozzle 10 communicates with a further conduit 14 arranged perpendicular to the first conduit. The two conduits 12 and 14 are connected to a two-way valve (not shown on the drawings).

On the injector carrier 2 there is mounted a base 16 provided with an annular portion 18 resting on the cooker surface 4. Said base 16 defines three venturi ducts 20,22 axially aligned with the nozzles 8 and 10.

The base 16 also comprises a raised edge 24 on which there rests an element 26 provided with a rim 28 in which a plurality of flame orifices 30 are provided.

Said element comprises in its centre a sleeve 32 which projects downwards to rest on a stepped annular portion 34 provided on the outer upper lateral surface of the venturi duct 22.

With its upper wall 36 and with the burner base 16 the element 26 defines a first mixing chamber 38 fed by the venturi ducts 20.

The element 26 also has a raised edge 40 comprising a plurality of orifices 42 offset from the orifices 30, on which there rests a cover 44 which with the upper wall 39 of the element 26 forming a second mixing chamber 46 fed by the venturi duct 22.

The burner of the invention is used in the following manner.

On rotating the valve control knob into a first configuration in which only the conduit 14 is fed, the gas emerges through the nozzle 10, entrains primary air and forms a gaseous mixture, which rises along the venturi duct 22, enters the chamber 46 and leaves it through the orifices 42 to burn and create a first ring of flames 48.

On further rotating the knob into a configuration in which the conduit 12 is also fed, the gas emerges from the nozzles 8, draws primary air through the apertures 6 and after passing through the venturi ducts 20 enters the chamber 38 to form a gaseous mixture which emerges through the orifices 30 to hence create a second ring of flames of greater length.

This configuration corresponds to burner maximum power delivery.

On further rotating the knob the gas feed to the conduit 12 is progressively decreased until it totally ceases, with consequent extinguishing of the flames 49 leaving the orifices 30.

On further rotating the knob the gas feed to the nozzle 10 is progressively decreased until the predetermined minimum value is reached.

This configuration corresponds to burner minimum power delivery.

From the a foregoing it is apparent that the burner of the invention presents numerous advantages, and in particular:

- a high power because of the provision of several venturi ducts,
- shorter flames for equal power as the air-gas mixture is divided between a greater number of orifices distributed on more than one level,
- better mixing as the total gas is divided between several nozzles and several venturi ducts,
- better efficiency as maximum power is achieved with flames which are shorter and hence concentrated in the central region of the pan,
- lower minimum power as the total rated power is distributed over two separate levels and the minimum is set on the basis of the thermal load of the upper burner and hence considerably lower than a normal single burner of the same rated power.

What is claimed is:

1. A gas burner assembly for a gas cooker comprising:

at least two nozzles selectively feedable through two mutually perpendicular conduits to form corresponding gas/air mixtures in two separate mixing chambers, with a first of said mixing chambers being concentrically positioned about a second of said mixing chambers, said first mixing chamber being in communication with a first ring of flame orifices and said second mixing chamber being in communication with a second ring of flame orifices, and said second ring of flame orifices being spaced vertically from said first ring of flame orifices.

2. The gas burner assembly of claim 1, wherein said flame orifices of said two different levels are radially offset.

3. The gas burner assembly of claim 1, wherein two of the at least two nozzles are axially aligned with two venturi ducts opening into said first one of the mixing chambers, and a third nozzle is axially aligned with a third venturi duct opening into said second one of the mixing chambers.

4. The gas burner assembly of claim 3, wherein the three venturi ducts are formed as a single piece.

5. The gas burner assembly of claim 4, wherein the three nozzles are mounted on a single piece which incorporates the two conduits and on which there is centered said single piece which incorporates the three venturi ducts.

6. A gas burner assembly for a gas cooker comprising:

a burner comprising at least two nozzles selectively feedable through two mutually perpendicular conduits to form corresponding gas/air mixtures in two separate mixing chambers provided with flame orifices, said flame orifices being positioned on two different levels;

wherein two of the at least two nozzles are axially aligned with two venturi ducts opening into a first one of the mixing chambers, and a third nozzle, fed by a separate conduit, is axially aligned with a third venturi duct opening into a second one of the mixing chambers;

wherein the three venturi ducts are formed as a single piece.

7. The gas burner assembly of claim 6, wherein the three nozzles are mounted on a single piece which incorporates the two conduits and on which there is centered said single piece which incorporates the three venturi ducts.

8. A gas burner assembly for a gas cooker comprising:

at least two nozzles selectively feedable through two mutually perpendicular conduits to form corresponding gas/air mixtures in two separate mixing chambers provided with flame orifices, said flame orifices being positioned on two different levels, wherein two of the at least two nozzles are axially aligned with two venturi ducts opening into a first one of the mixing chambers, and a third nozzle is axially aligned with a third venturi duct opening into a second one of the mixing chambers.

9. The gas burner assembly of claim 8, wherein the three venturi ducts are formed as a single piece.

10. The gas burner assembly of claim 9, wherein the three nozzles are mounted on a single piece which incorporates the two conduits and on which there is centered said single piece which incorporates the three venturi ducts.

* * * * *